US009222723B2

(12) United States Patent
Seeley

(10) Patent No.: US 9,222,723 B2
(45) Date of Patent: Dec. 29, 2015

(54) FOLDABLE RACK FOR A REFRIGERATOR

(71) Applicant: Whirlpool Corporation, Benton Harbor, MI (US)

(72) Inventor: Michael S. Seeley, South Haven, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 13/937,470

(22) Filed: Jul. 9, 2013

(65) Prior Publication Data

US 2015/0015132 A1 Jan. 15, 2015

(51) Int. Cl.
*F25D 25/02* (2006.01)

(52) U.S. Cl.
CPC ..... *F25D 25/02* (2013.01); *F25D 2331/803* (2013.01)

(58) Field of Classification Search
CPC . F25D 25/02; F25D 2331/803; F25D 31/007; F25D 25/027; A47B 73/00; A47B 73/004; A47B 57/04; A47F 7/28
USPC ..... 312/408, 351, 297, 116, 404; 108/28; 211/74
See application file for complete search history.

(56) References Cited

U.S. PATENT DOCUMENTS 2,155,884 A 4/1939 Barnes
2,330,044 A * 9/1943 Gaston ..... 312/293.2
2,419,040 A * 4/1947 Stepanian ..... 211/74
3,352,431 A * 11/1967 Smith ..... 211/208
D255,520 S 6/1980 Lyons
4,318,485 A * 3/1982 Clement ..... 211/59.2
4,496,124 A 1/1985 Cole
4,515,334 A * 5/1985 Horne ..... 248/146
4,528,825 A * 7/1985 Khan ..... A47B 77/10 312/313
4,775,201 A * 10/1988 Thomson ..... F25D 25/021 312/248
4,795,038 A 1/1989 Johnson
4,936,641 A * 6/1990 Bussan et al. ..... 312/408
5,180,066 A * 1/1993 McArdle ..... 211/74
5,323,917 A 6/1994 Johnson et al.
5,573,123 A 11/1996 LaLonde
5,577,823 A * 11/1996 Maglinger ..... 312/404
5,624,043 A 4/1997 Baptista
6,880,902 B2 4/2005 Zimmerman
6,932,449 B2 8/2005 Collins et al.
7,080,743 B1 7/2006 Wolseth
D527,586 S 9/2006 Bacchus
7,195,125 B1 * 3/2007 Wolseth et al. ..... 211/74

(Continued)

FOREIGN PATENT DOCUMENTS

CN 1015763040 A 11/2009
CN 202002429 U 10/2011

(Continued)

*Primary Examiner* — Janet M Wilkens
*Assistant Examiner* — Hiwot Tefera

(57) ABSTRACT

A refrigerator comprising a cabinet, a liner disposed within the cabinet and defining an interior fresh food compartment, a wine rack rotatably mounted within the fresh food compartment, the wine rack comprising a substantially planar plate having a first end and a second end with at least one aperture sized to receive a neck portion of a bottle to hold the bottle substantially horizontally in a cantilever fashion; a pair of attachment elements disposed on the first end and second end of the substantially planar plate to support the substantially planar plate and configured to secure the substantially plate to the refrigerator.

18 Claims, 8 Drawing Sheets

(56) References Cited

U.S. PATENT DOCUMENTS

| | | | | |
|---|---|---|---|---|
| 7,350,647 | B2 * | 4/2008 | Haller et al. | 211/75 |
| 7,950,756 | B2 * | 5/2011 | Collins et al. | F25D 25/02 312/248 |
| 8,033,402 | B1 | 10/2011 | Bevis | |
| 8,056,997 | B2 * | 11/2011 | Baek | 312/405.1 |
| 8,833,875 | B2 * | 9/2014 | Arslankiray et al. | 312/116 |
| 2004/0089621 | A1 * | 5/2004 | Gangloff | 211/74 |
| 2004/0195945 | A1 * | 10/2004 | Farber et al. | 312/408 |
| 2006/0059934 | A1 * | 3/2006 | Howington et al. | 62/256 |
| 2007/0228909 | A1 * | 10/2007 | Hwang et al. | 312/408 |
| 2013/0162133 | A1 * | 6/2013 | Arslankiray et al. | 312/405 |
| 2014/0246554 | A1 * | 9/2014 | Forbus | F25D 25/02 248/318 |

FOREIGN PATENT DOCUMENTS

| | | | |
|---|---|---|---|
| CN | 102384631 | A | 3/2012 |
| DE | 102010039624 | A1 | 2/2012 |
| GB | 2265304 | A | 9/1993 |
| KR | 1020030023076 | A | 3/2003 |

* cited by examiner

FOLDABLE RACK FOR A REFRIGERATOR

BACKGROUND OF THE INVENTION

A refrigerator is an appliance used to store food items at preset temperatures. A refrigerator appliance typically includes one or more temperature-controlled compartments into which food items may be placed to preserve the food items for later consumption. A refrigerator appliance also typically includes a plurality of shelves on which the food items may be arranged within the one or more temperature-controlled compartments. One problem with this type of refrigerator is that for certain types of containers, like wine bottles for instance, a refrigerator shelf may present space issues. The bottle may be too tall to fit within the space between the shelves. The shelves may not be convenient to lay a bottle down on its side, as the bottle may roll back and forth on the shelf. As such, a refrigerator may also include a rack for the storage of wine or other drinks with a suitable bottle for holding by the neck through an aperture. The rack may be attached to the shelves within the one or more temperature-controlled compartments.

SUMMARY OF THE PRESENT INVENTION

In one aspect, a refrigerator may include a cabinet, a liner, a fresh food compartment, a plurality of movable shelves, a plurality of shelf ladders, and a wine rack assembly, the wine rack assembly comprising a wine rack and a pair of wine rack brackets.

In another aspect, a refrigerator may include a cabinet, a liner, a fresh food compartment, a plurality of movable shelves, a plurality of shelf ladders, and a wine rack assembly, the wine rack assembly comprising a wine rack with a pair of pins, and a pair of wine rack brackets with holes corresponding to the pins on the wine rack.

In yet another aspect of the present invention a refrigerator may include a cabinet, a liner, a fresh food compartment, and a wine rack assembly, the wine rack assembly comprising a wine rack with at least four pins, and at least four liner grommets corresponding to the four rack pins.

In yet another aspect of the present invention a refrigerator may include a cabinet, a liner, a fresh food compartment, and a wine rack assembly, the wine rack assembly comprising a wine rack with at least two pins and at least two spring pin assemblies, and at least six liner grommets corresponding to the two rack pins and at least two spring pin assemblies in at least two different positions.

In another aspect, a refrigerator may include a cabinet, a liner, a fresh food compartment, a plurality of movable shelves, a plurality of shelf ladders, and a wine rack assembly, the wine rack assembly comprising a wine rack with a pair of pins, and a pair of wine rack brackets with corresponding attachments to the shelf ladders.

In still another aspect, a refrigerator may include a cabinet, a liner, a fresh food compartment, a plurality of movable shelves, a plurality of shelf ladders, and a wine rack assembly, the wine rack assembly comprising a wine rack and a pair of wine rack brackets, wherein the wine rack comprises a number of spaced round holes to hold bottles of wine substantially horizontal.

In still another aspect, a refrigerator may include a cabinet, a liner, a fresh food compartment, a plurality of movable shelves, a plurality of shelf ladders, and a wine rack assembly, the wine rack assembly comprising a wine rack and a pair of wine rack brackets, wherein the wine rack comprises a number of elongated holes to hold different sized bottles of wine substantially horizontal.

These and other aspects, objects, and features of the present invention will be understood and appreciated by those skilled in the art upon studying the following specification, claims, and appended drawings.

DETAILED DESCRIPTION OF EMBODIMENTS

Figure 1:
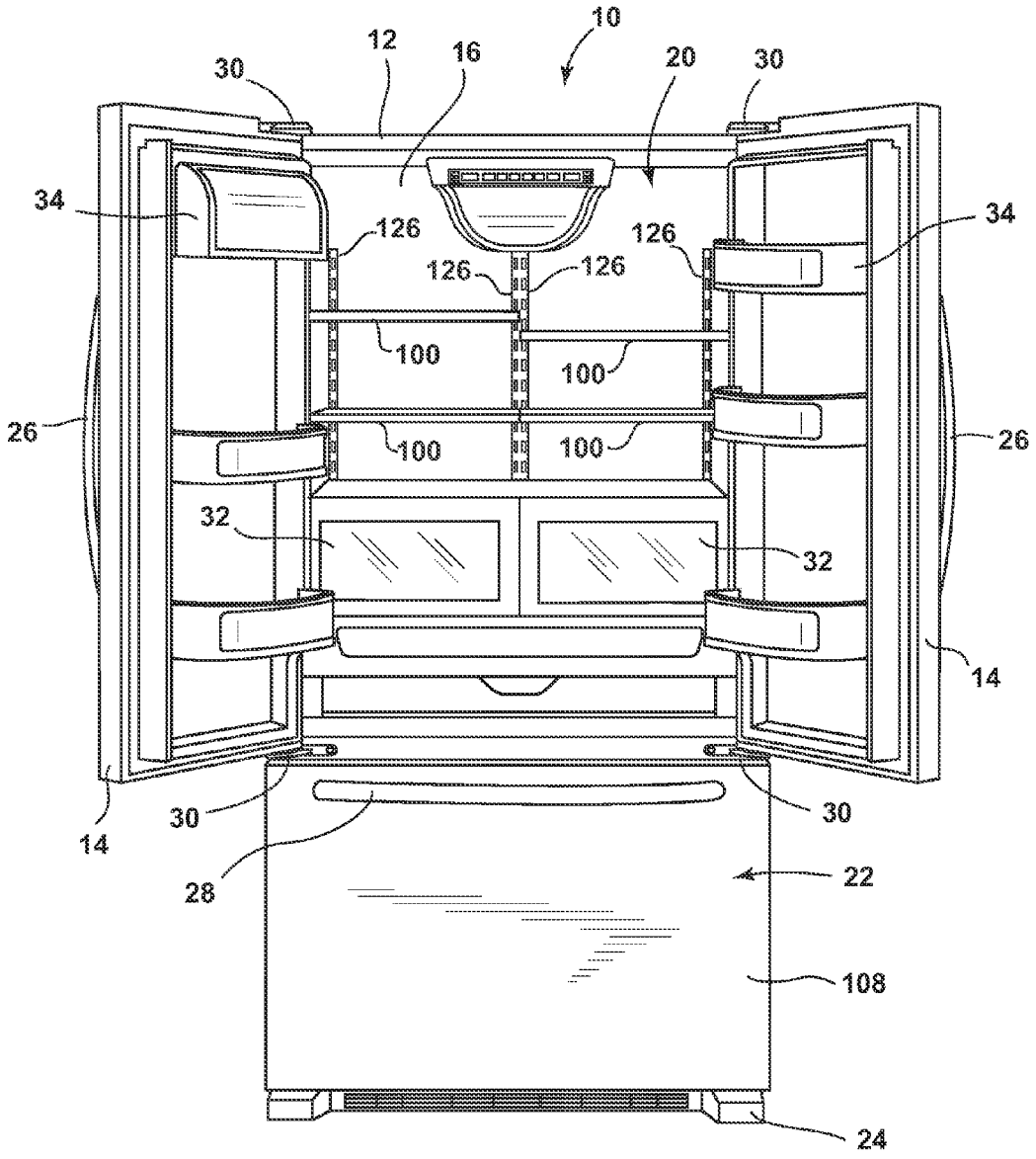
FIG. 1 is a front elevation view of a refrigerator showing a number of adjustable shelves mounted on a number of shelf ladders within a fresh-food compartment of the refrigerator.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Referring to FIG. 1, a home appliance is shown as a refrigerator appliance 10 (hereinafter, the refrigerator 10). The refrigerator 10 includes a lower frame 24 and a cabinet 12 extending upwardly from the lower frame 24. The cabinet 12 of the refrigerator 10 includes a pair of inner liners 16 that define a pair of inner temperature-controlled compartments that are independently operable to maintain food items stored therein at one or more set temperatures.

The lower temperature-controlled compartment is a freezer compartment 22, and the refrigerator 10 includes a drawer 108 that is positioned in the freezer compartment 22. The drawer 108 is moveable relative to the cabinet 12 such that food items may be placed in the drawer 108 for storage in the freezer compartment 22 and retrieved from the drawer 108 when ready for use. A handle 28 is located on the drawer 108 so that a user may open and close the drawer 108.

The upper temperature-controlled compartment is a fresh food compartment 20 into which a user may place and store food items such as milk, cheese, produce, etcetera. A pair of doors 14 are each hinged to the front of the cabinet 12 via a pair of hinge assemblies 30. The doors 14 permit user access to the fresh food compartment 20 such that food items may be placed in and retrieved from the fresh food compartment 20. A handle 26 is located on each of the doors 14 so that a user may open and close the doors 14.

While the illustrative embodiment of the refrigerator 10 shown in FIG. 1 is a "french-door" model with a pair of doors 14 operable to permit access to the fresh food compartment 20, it should be appreciated that other configurations are contemplated, such as, for example, configurations having only one door 14 operable to permit access to the fresh food compartment 20. Additionally, it should also be appreciated that, in some embodiments, the freezer compartment 22 may be positioned above the fresh food compartment 20 and, in other embodiments, either one of the temperature-controlled compartments may be omitted. It should be further appreciated that, in some embodiments, the refrigerator 10 may include more than one freezer compartment 22 and/or more than one fresh food compartment 20. Configurations of the refrigerator 10 are also contemplated in which the freezer compartment 22 is located on one side of the cabinet 12 and the fresh food compartment 20 is located on the opposite side of the cabinet 12.

As shown in FIG. 1, the refrigerator 10 may also include four adjustable shelves 100 removably mounted within the fresh food compartment 20, upon which a user of the refrigerator 10 may arrange food items. It is contemplated that the refrigerator 10 may include any number of adjustable shelves 100 within the fresh food compartment 20. As the adjustable shelves 100 are removably mounted within the fresh food compartment 20, a user may remove any adjustable shelf 100 and relocate it to any available shelf mounting position within the fresh food compartment 20. It will be appreciated that the refrigerator 10 may additionally or alternatively include other devices for supporting or storing food within the fresh food compartment 20, such as, for example, drawers 32 or door bins 34 (as shown in FIG. 1). As used in the present disclosure, the term "shelf" is to be considered in its broadest sense as any device that will hold a food item, including shelves, drawers, bins, panels, racks, and the like.

The adjustable shelves 100 may be removably mounted within the fresh food compartment 20 using any suitable mechanism. In the illustrative embodiment of the refrigerator 10 shown in FIG. 1, four shelf ladders 126 are disposed within the fresh food compartment 20 to provide a plurality of shelf mounting positions for the adjustable shelves 100. It is contemplated that any number of shelf ladders 126 may be used for removably mounting the adjustable shelves 100. In some embodiments, the shelf ladders 126 may be secured to one or more walls of the fresh food compartment 20 using screws, bolts, rivets, adhesive, or other fixation mechanisms. In other embodiments, the shelf ladders 126 may be integrally formed into one or more walls of the fresh food compartment 20. It should also be appreciated that the adjustable shelves 100 may be removably mounted within the fresh food compartment 20 using any number of mechanisms other than the shelf ladders 126. By way of example, the adjustable shelves 100 may be removably mounted within the fresh food compartment 20 using ledges, tracks, slides, glides, rollers, and the like.

Figure 2:
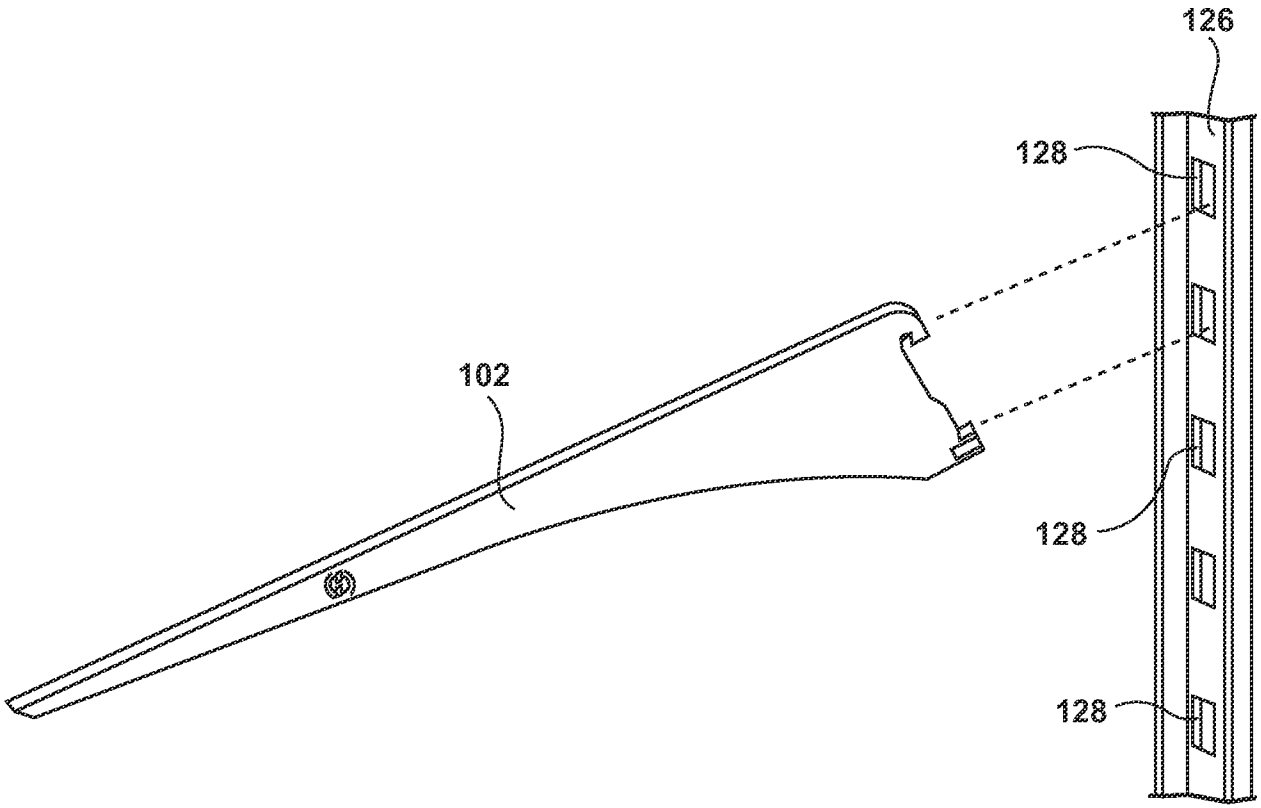
FIG. 2 is an exploded view of the adjustable shelf brackets and the shelf ladders within the fresh-food compartment of the refrigerator.

As shown in more detail in FIG. 2, each of the shelf ladders 126 in the illustrative embodiment of refrigerator 10 has a number of slots 128 defined therein. Each of the adjustable shelves 100 may illustratively include a pair of mounting brackets 102 that are spaced apart from one another the same distance as a pair of the shelf ladders 126. The mounting brackets 102 of an adjustable shelf 100 may each engage one or more slots 128 defined in one of the shelf ladders 126 to cantilever the adjustable shelf 100 to a pair of shelf ladders 126. As such, the slots 128 defined in the shelf ladders 126 provide a plurality of shelf mounting positions for the adjustable shelves 100. In the illustrative embodiment, the slots 128 defined in the shelf ladders 126 (and, hence, the shelf mounting positions) are spaced approximately one inch apart. It will be appreciated that other configurations for the spacing of the slots 128 and the shelf mounting positions are possible.

Figure 3A:
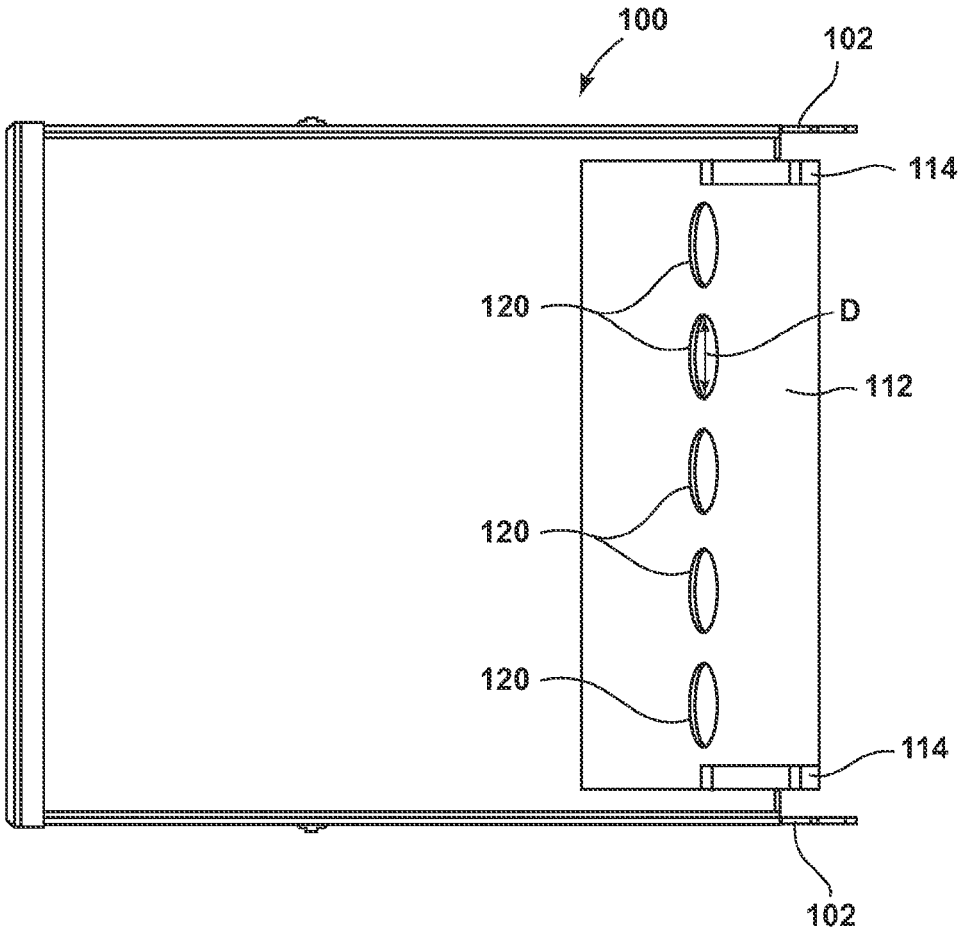
FIG. 3A is a plan view of a shelf with a wine rack installed.
Figure 3B:
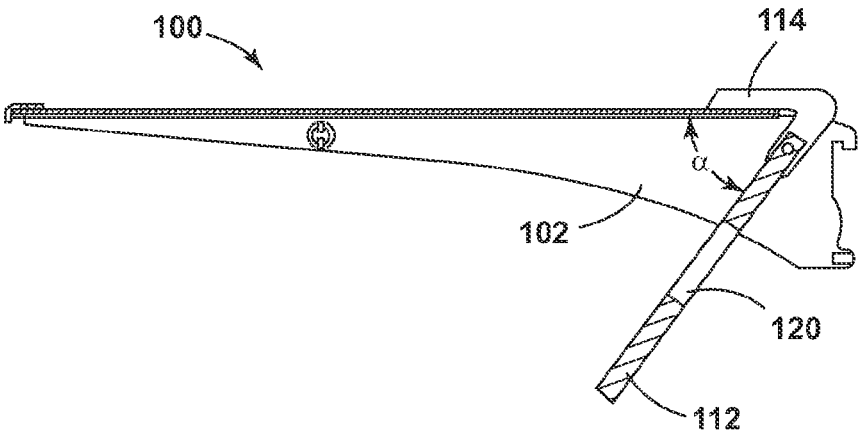
FIG. 3B is a side elevation of a shelf with a wine rack installed.

As shown in FIG. 3A-3B, a refrigerator 10 may include a wine rack assembly 110. The wine rack assembly 110 may have a wine rack 112 with a pair of wine rack brackets 114 on either end. The wine rack brackets 114 may be integrally formed to the ends of the wine rack 114, forming the wine rack assembly 114. It is also contemplated that the wine rack brackets may be attached using screws, bolts, rivets, adhesive, or other fixation mechanisms.

The wine rack assembly 110 may rest on a shelf 100 at the rear of the fresh food compartment 20. The wine rack assembly 110 may be rotated up from underneath the shelf 100 such that the wine rack brackets 114 fit in a space between the shelf 100 and the liner 16. The wine rack assembly 110 may rest loosely on the shelf 100, held in place by the force of gravity on the wine rack 112. The wine rack assembly 110 may also be fitted to specific refrigerator designs for the space between the shelf 100 and the rear wall of the cabinet 12. The wine rack brackets 114 may also simply have a portion that extends out from the wine rack bracket 114 toward the rear wall of the cabinet 12 to prevent the wine rack assembly from rotating farther than desired. It is also contemplated that the wine rack assembly may be placed on the shelf 100 before the shelf 100 is located to the shelf ladders 126.

The wine rack 112 may be a plate. The plate thickness may be within a range of 2 mm to 25 mm, preferably about 5 mm in thickness. The wine rack 112 may include a plurality of apertures 120. The apertures 120 may be sized to allow the neck of a conventional wine bottle to pass through the aperture 120 and hold the bottle substantially horizontally in a cantilever fashion. The size of the aperture 120 necessary is a function of thickness of the plate and the angle of the wine rack 112 in its wine bottle storage position. As the thickness of the plate used in the wine rack 112 increases, the diameter D of aperture 120 may also increase to accommodate the neck of a conventional wine bottle. Similarly, as the thickness of the plate used in the wine rack 112 decreases, the diameter D of the aperture 120 may also decrease. The diameter D of the aperture 120 may be between 30 mm and 50 mm, preferably about 35 mm. As the angle $\alpha$ of the wine rack 112 increases, the diameter D of the aperture 120 may decrease. Similarly, as the angle $\alpha$ of the wine rack 112 decreases, the diameter D of the aperture 120 may increase. The angle $\alpha$ of the wine rack 112 may be between 90 and 45 degrees, preferably about 57 degrees.

Figure 4A:
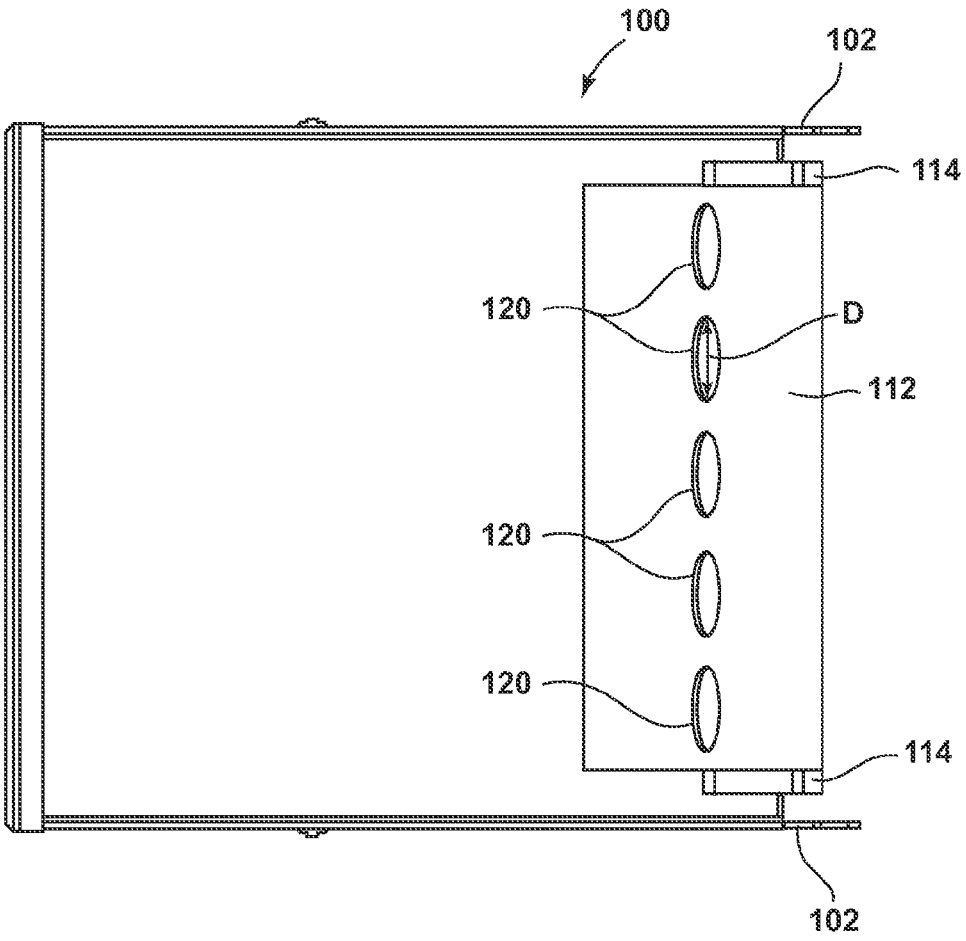
FIG. 4A is a plan view of another embodiment with the shelf and wine rack installed.
Figure 4B:
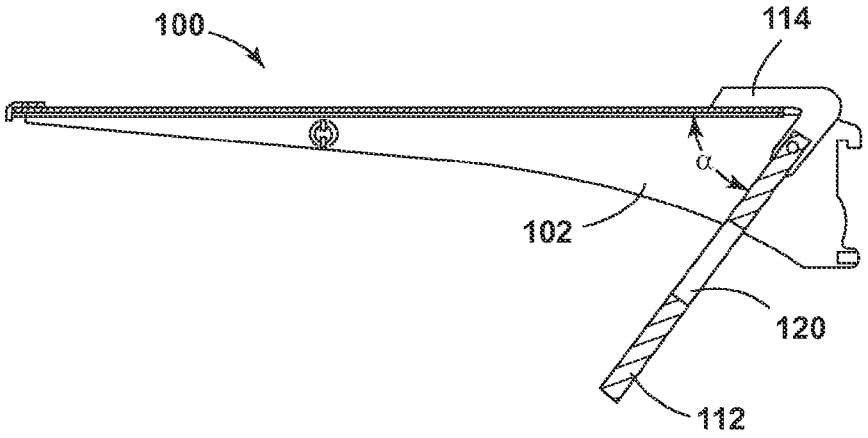
FIG. 4B is a side elevation of another embodiment with the shelf and wine rack installed.
Figure 4C:
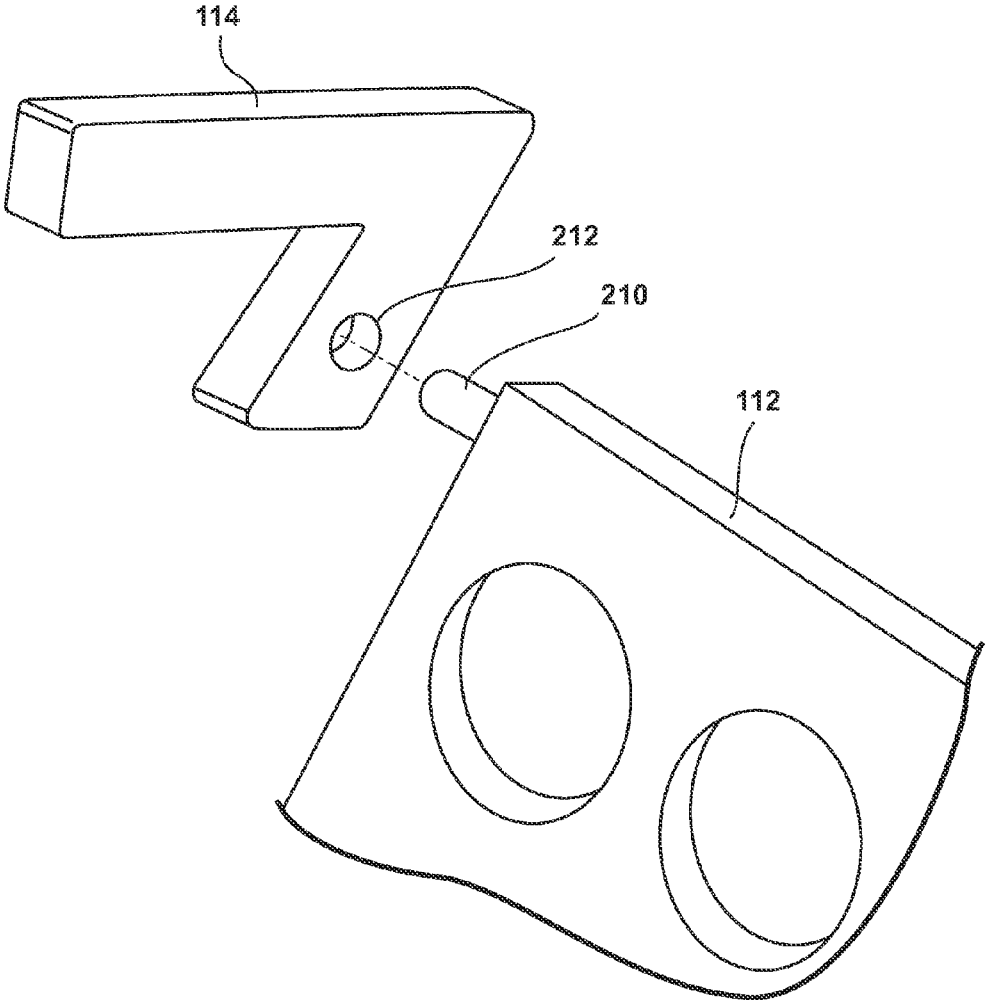
FIG. 4C is an isometric exploded view of a wine rack and the wine rack bracket in an embodiment.

As shown in FIG. 4A-4C, in another embodiment, the wine rack 112 may be rotatably connected to the wine rack brackets 114. The wine rack 112 may be movable between a first position where it is stowed underneath the shelf 100, and a second position where the wine rack 112 may hold bottles in a preferred position. The wine rack brackets 114 may include round holes 212 and the wine rack 112 may include corresponding round pins 210. The pins 210 and holes 212 may be sized as an interference fit such that the rack 112 stays in the first stowed position when not in use. It is further contemplated that other shapes may be used other than round to act as hard stops for the rack in the first and second positions. It is also contemplated that hinges of a type known in the art may be used between the wine rack 112 and the brackets 114.

Figure 5A:
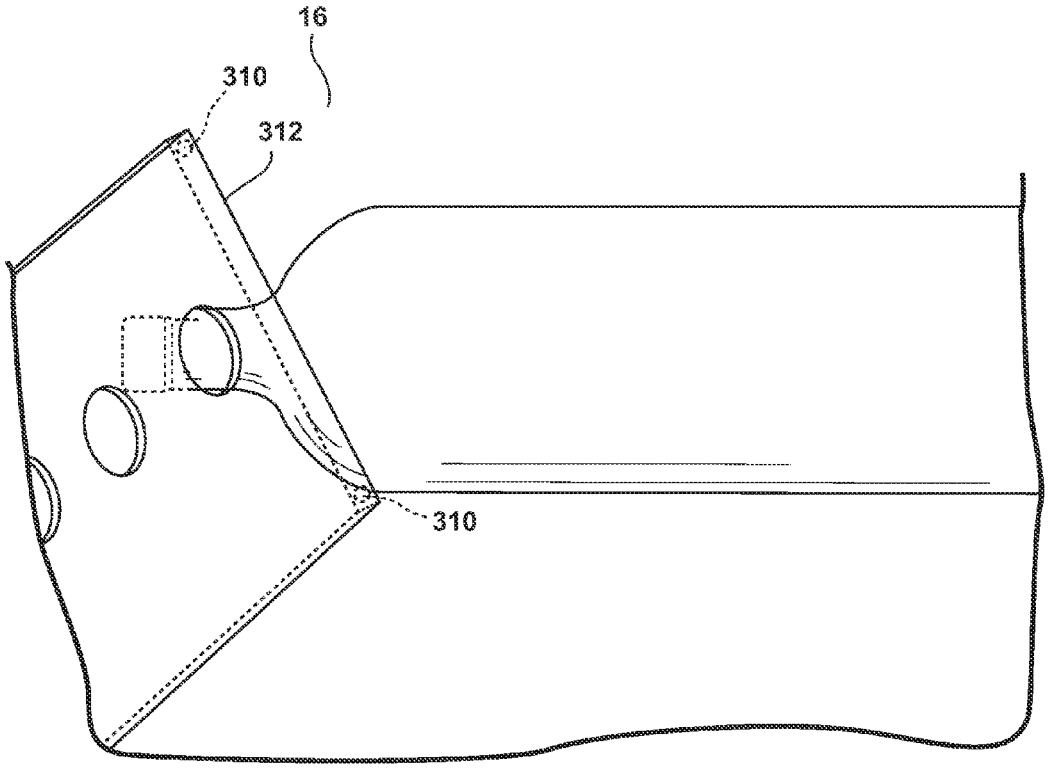
FIG. 5A is an isometric view of an embodiment of the wine rack and the liner.
Figure 5B:
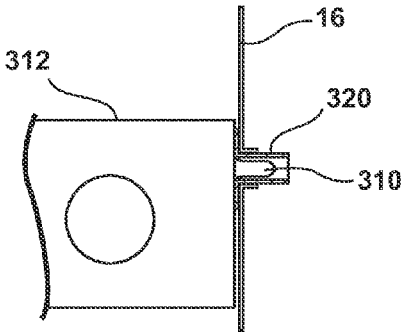
FIG. 5B is a section view of the liner, liner grommet, rack pin, and wine rack in an embodiment.

In a further embodiment as shown in FIGS. 5A-5B, a wine rack attaches directly to the liner 16. The wine rack 312 may include at least 4 rack pins 310 sized to fit within liner grommets 320 located in the liner 16. The liner grommets 320 are spaced such that the wine rack 312 holds the conventional wine bottle substantially horizontal.

Figure 5C:
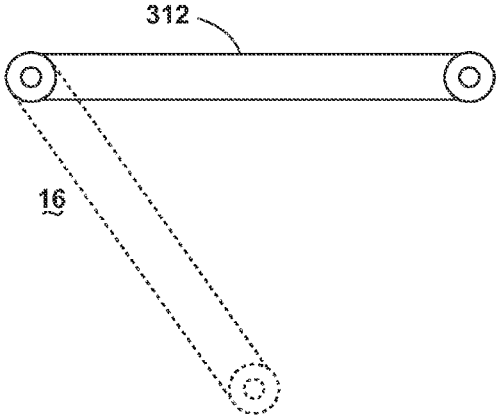
FIG. 5C. is a side elevation view of an embodiment with a wine rack, rack pins, liner, and liner grommets.
Figure 5D:
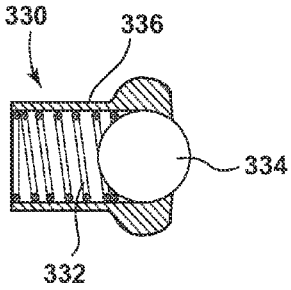
FIG. 5D is a section through a spring pin assembly in an embodiment.

It is also contemplated as shown in FIGS. 5C-5D that the wine rack 312 be rotatable about the upper pin 310 between a first stowed position and a second wine bottle storage position. In this embodiment, the lower pin 310 would be a spring loaded pin assembly 330. The spring loaded spring assembly 330 may include a spring 332, a pin ball 334, and a rack grommet 336. When in the first or second position, the force of the spring 332 may push the pin ball 334 outward from the rack 312. The rack grommet 336 would have a shape to allow the pin ball 334 to extend beyond the end of the rack grommet 336, but remain contained within the rack grommet 336. The portion of the pin ball 334 that extends beyond the end of the rack grommet 336 would extend into the corresponding liner grommet 320, preventing the rack 312 from any undesired movement. While the spring loaded pin assembly 330 prevents undesired movement, it is also designed to be easily moved by a user from one of the first or second position to the other using hand forces only. It has also been contemplated that the refrigerator 10 include a spring loaded wine rack 312 such that the wine rack 312 spring back to the first stowed position when there is no load on the wine rack 312, i.e. when no bottles are being stored.

Figure 6:
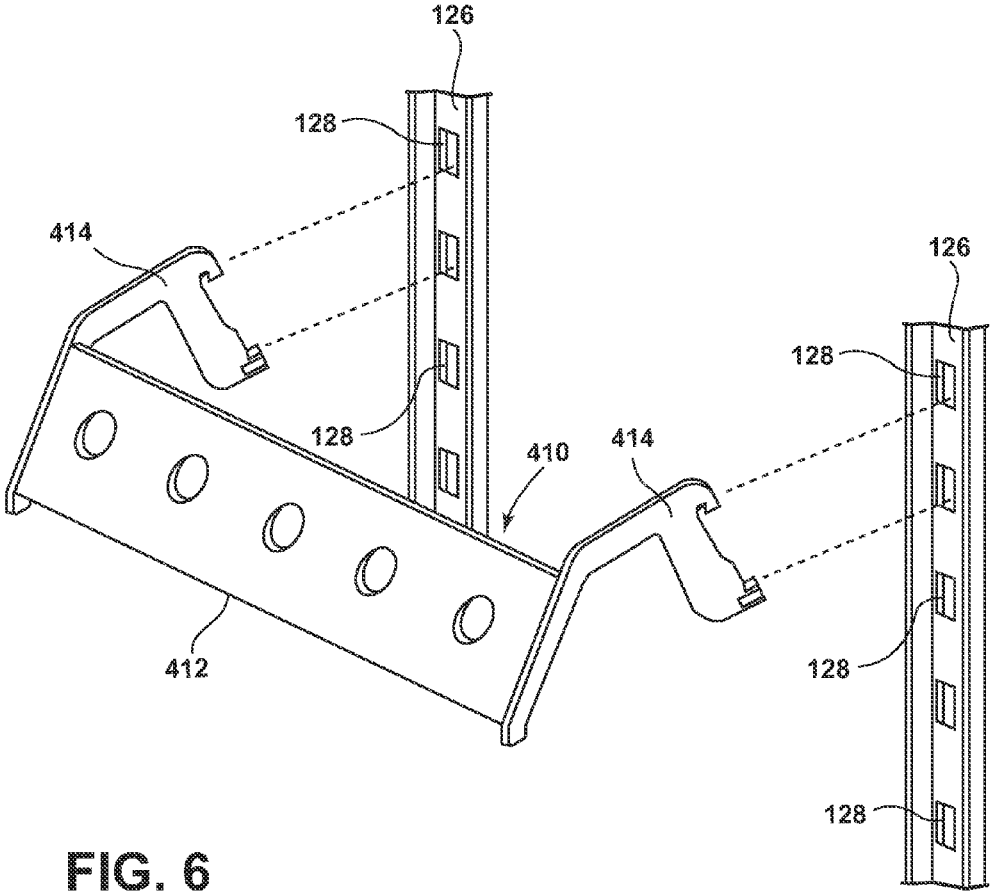
FIG. 6 is an isometric view of the wine rack, wine rack brackets, shelf ladders, and liner in another embodiment.

In another embodiment, as shown in FIG. 6, the wine rack assembly 410 includes a wine rack 412 and a pair of wine rack brackets 414. The wine rack brackets 414 are shaped similarly to the shelf brackets 102 as described in detail above. The wine rack brackets 414 attach to the shelf ladders 126 in the same way as the shelf brackets 102 described above.

Figure 7A:
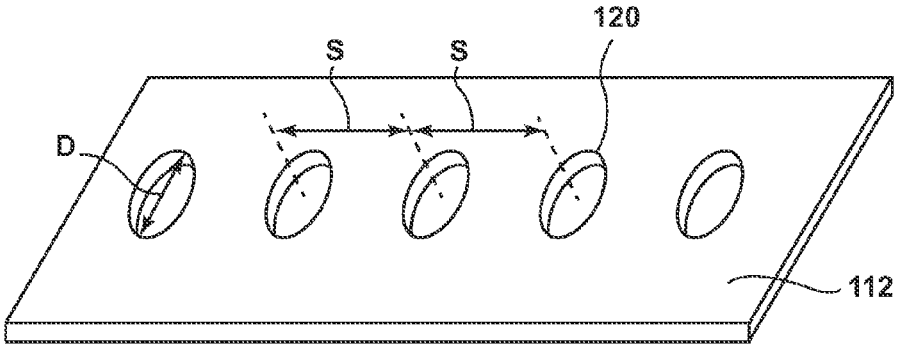
FIG. 7A is an isometric view of a wine rack in a typical embodiment.
Figure 7B:
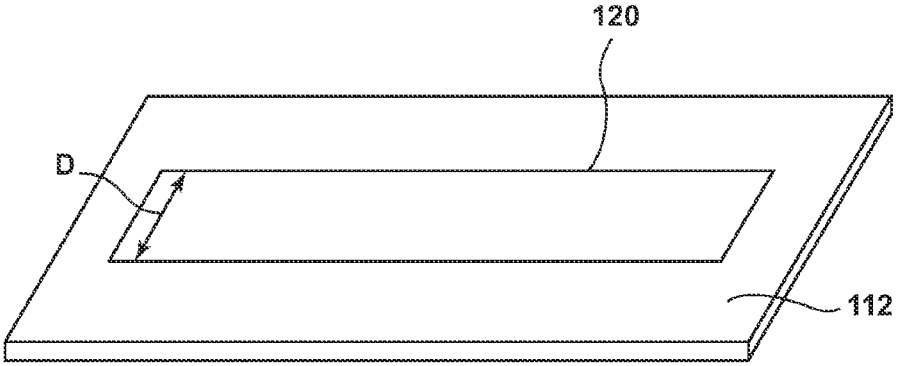
FIG. 7B is an isometric view of a wine rack in another embodiment.

As shown in FIG. 7A, in order to accommodate standard wine bottles, the spacing of the apertures 120 on the wine rack 112 should be a minimum of 62 mm, and preferably greater than or about 87 mm. It has been contemplated in order to accommodate many different sized bottles, both standard and non-standard, that the wine rack have one or more non-circle apertures with a width equal to the diameter D as contemplated above. This could be one single rectangle aperture as shown in FIG. 7B, or more apertures either rectangle or oval in shape with a width equal to the diameter D as contemplated above. It has also been contemplated that the wine rack could extend along the entire width of the fresh food compartment in any of the above embodiments. It has further been contemplated that other types of bottles such as bottles of soda or juice, or anything else in a bottle with a neck that may fit into the apertures may be suitable for this rack.

Figure 8:
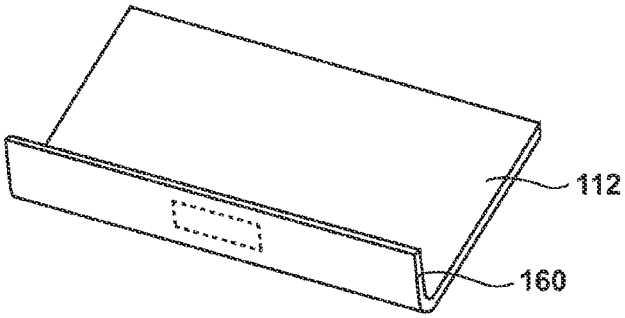
FIG. 8 is an isometric view of an embodiment of a wine rack with an upstanding flange for logo or other information display.

As shown in FIG. 8, in another embodiment, the wine rack 112 also has an upstanding flange 160 upon which a logo or other information could be displayed when the wine rack 112 is in a first position.

It will be understood by one having ordinary skill in the art that construction of the described invention and other components is not limited to any specific material. Other exemplary embodiments of the invention disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the invention as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present invention. The exemplary structures and processes disclosed herein are for illustrative purposes and are not to be construed as limiting.

It is also to be understood that variations and modifications can be made on the aforementioned structures and methods without departing from the concepts of the present invention, and further it is to be understood that such concepts are intended to be covered by the following claims unless these claims by their language expressly state otherwise.

What is claimed is:

1. A refrigerator comprising:

a cabinet;

a liner disposed within the cabinet and defining an interior fresh food compartment;

a shelf mounted within the fresh food compartment;

a wine rack rotatably mounted within the fresh food compartment, the wine rack comprising:

a substantially planar plate having a first end and a second end with at least one aperture sized to receive a neck portion of a bottle to hold the bottle substantially horizontally in a cantilever fashion; and a pair of attachment elements disposed on the first end and the second end of the substantially planar plate to support the substantially planar plate and configured to secure the substantially planar plate to the refrigerator, wherein the pair of attachment elements is configured to allow the substantially planar plate to rotate between a first position, where the wine rack is stowed beneath the shelf, and a second position, where the wine rack is capable of holding a bottle with a neck portion of the bottle being received in the at least one aperture.

2. The refrigerator of claim 1, further comprising a plurality of shelf ladders secured to the cabinet, and said shelf is configured to removably attach to one or more of the plurality of shelf ladders.

3. The refrigerator of claim 2, wherein the angle between the wine rack and the shelf is between 45 and 90 degrees when the substantially planar plate is in the second position.

4. The refrigerator of claim 2, wherein the pair of attachment elements are configured to rest on a rear portion of the shelf and hold the substantially planar plate below the shelf.

5. The refrigerator of claim 4, wherein the pair of attachment elements further comprise a hinge element configured to allow the substantially planar plate to rotate between the first position and the second position.

6. The refrigerator of claim 1, wherein the liner further comprises a pair of upper liner grommets defining an axis of rotation of the substantially planar plate, and a pair of lower liner grommets defining the first position for the substantially planar plate.

7. The refrigerator of claim 6, wherein the liner further comprises a second pair of lower liner grommets further defining the second position for the substantially planar plate.

8. The refrigerator of claim 6, wherein the pair of attachment elements further comprise a pair of upper pins corresponding to the upper liner grommets, and a pair of lower pins corresponding to the lower liner grommets.

9. The refrigerator of claim 7, wherein the pair of attachment elements further comprise a pair of upper pins corresponding to the upper liner grommets, and a pair of lower spring pins corresponding to the lower liner grommets, wherein the lower spring pins are configured to hold the substantially planar plate in one of the first and second position.

10. The refrigerator of claim 1, wherein the pair of attachment elements constitutes a pair of brackets.

11. The refrigerator of claim 10, wherein the pair of brackets further comprise a hinge element configured to allow the substantially planar plate to rotate between the first position and the second position.

12. The refrigerator of claim 10, wherein the liner further comprises a pair of upper liner grommets defining an axis of rotation of the substantially planar plate, and a pair of lower liner grommets defining the first position for the substantially planar plate.

13. The refrigerator of claim 12, wherein the liner further comprises a second pair of lower liner grommets further defining the second position for the substantially planar plate, and wherein the pair of brackets further comprises a pair of upper pins corresponding to the upper liner grommets, and a pair of lower spring pins corresponding to the lower liner grommets, wherein the lower spring pins are configured to hold the substantially planar plate in one of the first and second position.

14. The refrigerator of claim 12, wherein the pair of brackets further comprises a pair of upper pins corresponding to the upper liner grommets, and a pair of lower pins corresponding to the lower liner grommets.

15. The refrigerator of claim 1, wherein the pair of attachment elements constitutes a pair of brackets, wherein the pair of brackets is configured with an upper portion to rest on a top face of said shelf and a lower portion coupled to the first end and second end of the substantially planar plate.

16. The refrigerator of claim 15, wherein the wine rack further comprises a pair of pins and the brackets further comprise a hole corresponding to the pair of pins, wherein the pair of pins and holes are sized to hold the wine rack in one of the first position and the second position.

17. The refrigerator of claim 1, wherein the substantially planar plate is:

rotatable relative to the pair of attachment elements; or rotatable about the pair of attachment elements.

18. The refrigerator of claim 1, further comprising a plurality of shelves mounted at spaced locations within the fresh food compartment and including planar portions configured to support food items, wherein the wine rack is separate and distinct from each of the planar portions.

* * * * *